US007731552B1

(12) United States Patent
Pelini

(10) Patent No.: US 7,731,552 B1
(45) **Date of Patent: *Jun. 8, 2010**

(54) MANUALLY OPERATED JACK PLATE/TRAVEL STOP SYSTEM

(76) Inventor: Mark F. Pelini, 406 Senoma Dr., Valrico, FL (US) 33594

( * ) Notice: Subject to any disclaimer, the term of this patent is extended or adjusted under 35 U.S.C. 154(b) by 198 days.

This patent is subject to a terminal disclaimer.

(21) Appl. No.: 12/077,608

(22) Filed: Mar. 20, 2008

(51) Int. Cl.
*B63H 5/20* (2006.01)

(52) U.S. Cl. ..... 440/53; 440/59

(58) Field of Classification Search ..... 440/53, 440/59

See application file for complete search history.

(56) References Cited

U.S. PATENT DOCUMENTS 4,227,480 A 10/1980 Carras
4,559,889 A 12/1985 Olson
5,041,032 A * 8/1991 Makihara et al. ..... 440/53
5,052,320 A 10/1991 Cremer
5,782,662 A * 7/1998 Icenogle ..... 440/61 R
5,944,568 A * 8/1999 Rabal ..... 440/53
5,997,370 A 12/1999 Fetchko
6,132,271 A * 10/2000 Hebert ..... 440/59
7,390,231 B1 * 6/2008 Pelini ..... 440/61 E
7,527,539 B1 * 5/2009 Pelini ..... 440/61 R

* cited by examiner

*Primary Examiner*—Stephen Avila
(74) *Attorney, Agent, or Firm*—Edward P. Dutkiewicz

(57) ABSTRACT

The jack plate has two vertically aligned side plates and a transom plate. A travel stop block is couple to the jack plate transom plate. The travel stop block is located between an upper and lower transom bars. The operational height of the jack plate can be manually operated by turning a hex head threaded rod.

5 Claims, 6 Drawing Sheets

MANUALLY OPERATED JACK PLATE/TRAVEL STOP SYSTEM

The Applicant has submitted a related pending non-provisional application on Oct. 3, 2007, bearing Ser. No. 11/906,708. The disclosed application is for a jack plate having a parallelogram configuration. The invention is made by a single inventor, so there are no other inventors to be disclosed. This application is not under assignment to any other person or entity at this time.

BACKGROUND OF THE INVENTION

1. Field of the Invention

The present invention relates to a jack plate/travel stop system and more particularly pertains to abating the inadvertent wetting of a height adjusting hydraulic cylinder in a safe, convenient and economical manner without the use of a drive motor.

2. Description of the Prior Art

The use of stop systems of known designs and configurations is known in the prior art. More specifically, stop systems of known designs and configurations previously devised and utilized for the purpose of abating wetting through known methods and apparatuses are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art patents do not describe a manually operated jack plate/travel stop system that allows for a safe economical device for the adjusting the operating height of an outboard motor, relative to the transom of a boat, in a safe, convenient and economical manner.

In this respect, the manually operated jack plate/travel stop system according to the present invention substantially departs from the conventional concepts and designs of the prior art, and in doing so provides a device for the adjusting the operating height of an outboard motor, relative to the transom of a boat, in a safe, convenient and economical manner.

Therefore, it can be appreciated that there exists a continuing need for a new and improved manual operated jack plate/travel stop system which can be used for abating the inadvertent wetting of a height adjusting hydraulic cylinder in a safe, convenient and economical manner. In this regard, the present invention substantially fulfills this need.

SUMMARY OF THE INVENTION

In view of the foregoing disadvantages inherent in the known types of stop systems of known designs and configurations now present in the prior art, the present invention provides an improved manual operated jack plate/travel stop system. As such, the general purpose of the present invention, which will be described subsequently in greater detail, is to provide a new and improved manual operated jack plate/travel stop system and method which has all the advantages of the prior art and none of the disadvantages.

To attain this, the present invention essentially comprises a manual operated jack plate/travel stop system. First provided is a generally rectilinear transom plate. The transom plate has a forward surface and a rearward surface. The forward surface is placed in contact with the boat transom. The transom plate has a first thickness, or first external dimension, referred to as the edge. The transom plate has two side edges, a top edge, and a bottom edge. The transom plate is position-able on the transom of a boat. The transom plate has a plurality of mounting bolt holes there through. The associated transom bolts (not shown, but known in the art) pass through the transom plate, and through the transom of a boat. The transom plate has a plurality of thread block holes there through.

The transom plate has an associated thread block. The thread block has a top, a bottom, and four sides, including a front side and a rear side. The thread block has a general rectilinear shape. The thread block as a plurality of threaded mounting block holes that are mated with the thread block holes in the transom plate. The thread block mounting holes are located on the front side of the thread block.

The thread block has a threaded shaft hole there through. The threaded shaft hole runs from the top of the thread block to the bottom of the thread block. The thread block shaft hole has an associated grease fitting for allowing grease to be pumped into the thread block shaft hole.

Next provided is a pair of similarly configured vertically disposed side rails. The side rails are mirror images of each other, each side plate having a front, a rear, a top, a bottom, an inner surface, and an outer surface. Each of the side rails has a forward edge and a rearward edge.

The side rails are in a generally trapezoidal configuration when viewed from the side, and an L-shaped configuration when viewed from above, or from top down. Each of the side rails has a short leg portion and a long leg portion. The short leg portion runs from the side plate, inwardly. The long leg portion runs from back to front, with the front having a generally rectangular enlargement running the length of the forward edge, from top to bottom.

The rectangular enlargement has a groove running from top to bottom. The rectangular enlargement has a grease fitting communicating with the surface of the groove. The groove has a second internal width, or dimension. The groove has an associated groove insert. The groove insert has a grease hole there through. The groove insert grease hole aligns with the grease fitting of the rectangular enlargement of the side rails.

The groove insert has a generally C-shaped configuration having an internal width, or dimension, and an external width, or dimension, and a depth. This configuration forms a recess. The internal width has a third dimension. The third dimension is larger than the first dimension of the transom side edge. This allows the transom side edge to be nested within the recess of the groove insert. The groove insert also has a fourth external dimension. The fourth external dimension is smaller than the second internal dimension of the side rail groove. This allows the insert to be nested within the side rail enlargement groove located in the forward end of the long leg portions of the side rail. This sizing allows the insert to be nested within the rectangular enlargement, and allows the side rail to slide up and down the length of the insert.

Each of the long leg portions of each of the side rails has a plurality of cross strut holes there through.

Each of the side rails has a rearwardly located short leg. The short leg of the side rail runs inwardly from each of the side rails, and forms a surface for receiving an outboard motor mount. Each of the short legs of the side rails has a forward surface and a rearward surface and a thickness there between. Each of the short legs of the side rails has a plurality of motor mount bolt holes there through.

Next provided are a plurality of cross struts. The cross struts have a generally solid cylindrical configuration (cylindrical being defined as continuous and of a single shape, not confined to being round). Two of the cross struts are rectangular shaped cylinders, and two of the cross struts are round cylinders. The rectangular configured struts each have two ends with a threaded bolt hole on each of the two ends. The round shaped struts each have two ends with each side having a protruding thread. The protruding thread is sized to fit into the apertures located in the side rails.

The cross struts couple the two side rails to from a rigid structure. There is a pair of upper cross struts and a single lower cross strut. The lower cross strut has a generally rectangular configuration with a top surface, a bottom surface, and a pair of parallel side surfaces. The lower cross strut has a rod aperture running from top to bottom at the approximate center of the cross strut, at a point approximately equidistant from the ends of the cross strut. The rod aperture has a stepped configuration having a smaller diameter aperture and a larger diameter recess associated there with. The larger diameter aperture being lowermost on the lower surface of the lower cross strut. The rod aperture has a grease fitting associated there with.

Provided last is a threaded rod. The threaded rod has a top end and a bottom end with a length there between. The threaded rod has a pair of locking nuts located at the lower end. The first locking nut has a hexagonal configuration and is nested within the recess of the lower cross strut rod aperture. The second locking nut has a flange and is located on the threaded rod above the lower cross strut, and contacting the lower cross strut. The locking nuts provide the connection between the threaded rod and the lower cross strut. The threaded rod is threaded into and through the threaded block, with the threads of the block and the rod being mated. The threaded rod then passes through the lower strut, and is coupled to the lower strut as described above. This configuration allows the turning of the threaded rod by turning of the hex head. The turning of the threaded rod then pulls up on the lower strut, lifting the side rails relative to the transom plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manually operated jack plate/travel stop system which has all of the advantages of the prior art stop systems of known designs and configurations and none of the disadvantages.

It is another object of the present invention to provide a new and improved jack plate/travel stop system which may be easily and efficiently manufactured and marketed.

It is further object of the present invention to provide a new and improved jack plate/travel stop system which is of durable and reliable constructions.

An even further object of the present invention is to provide a new and improved jack plate/travel stop system which is susceptible of a low cost of manufacture with regard to both materials and labor, and which accordingly is then susceptible of low prices of sale to the consuming public, thereby making such jack plate/travel stop system economically available to the buying public.

Even still another object of the present invention is to provide a jack plate/travel stop system for abating the inadvertent wetting of a height adjusting hydraulic cylinder in a safe, convenient and economical manner.

Lastly, it is an object of the present invention to provide a new and improved manually operated jack plate/travel stop comprising a transom plate, a thread block, and a pair of similarly configured side rails that are mirror images of each other. Also provided are a plurality of cross struts. There is a threaded rod having a top end and a bottom end with a length there between. The threaded rods provides a means for the manual operation of the system. The system also comprises a travel stop block.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a plan view of another embodiment of a hex head retainer. Note that there is a round bolt hole there through.

The same reference numerals refer to the same parts throughout the various Figures.

DESCRIPTION OF THE PREFERRED EMBODIMENT

Figure 1:
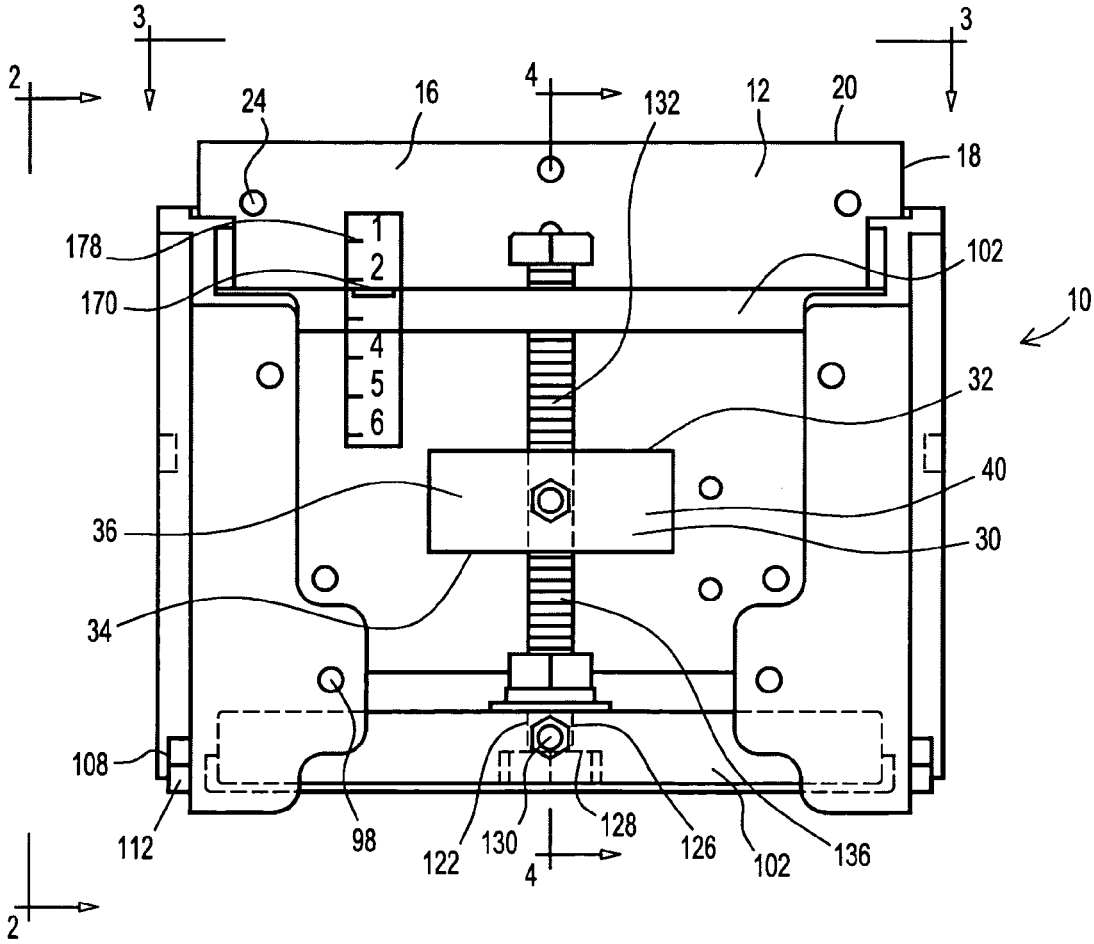
FIG. 1 is a forwardly looking elevational view of a manually operated jack plate/travel stop system constructed in accordance with the principles of the present invention.
Figure 2:
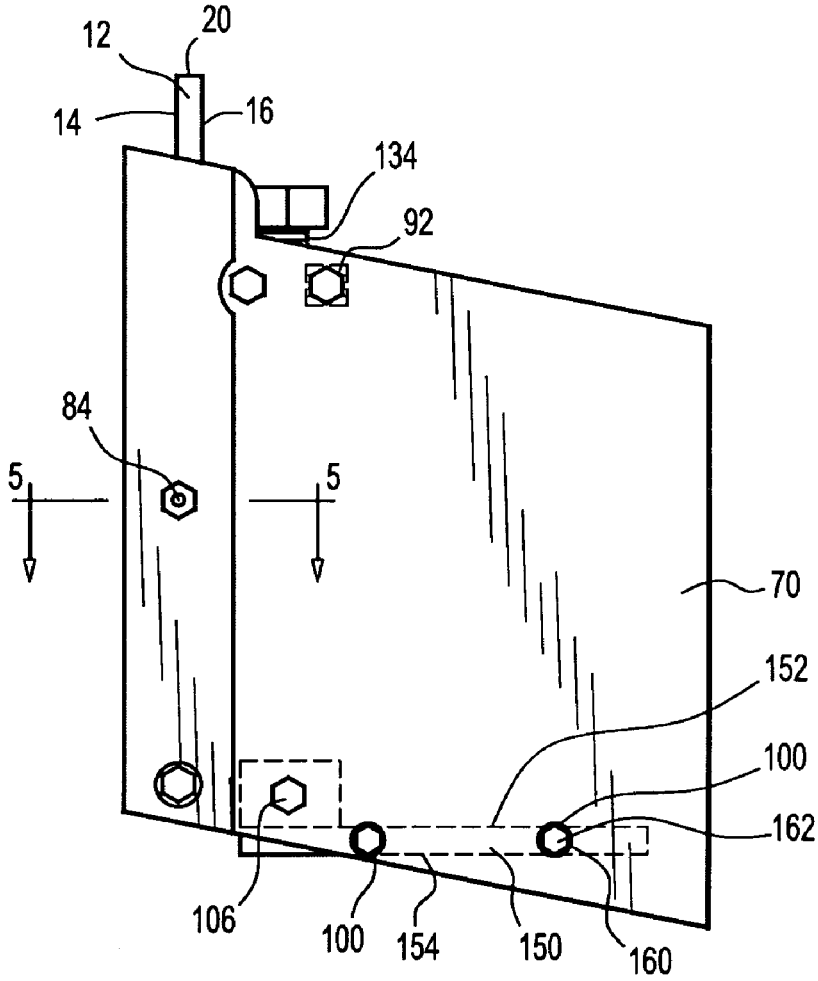
FIG. 2 is a side elevational view of the system taken along line 2-2 of FIG. 1.
Figure 3:
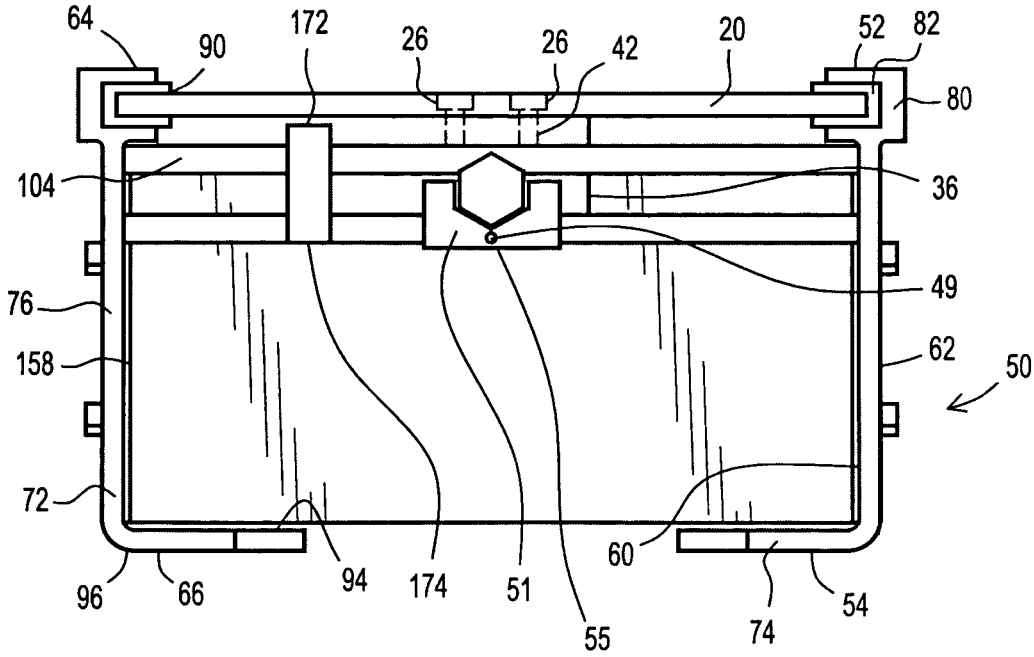
FIG. 3 is a top plan view of the system taken along line 3-3 of FIG. 1.
Figure 4:
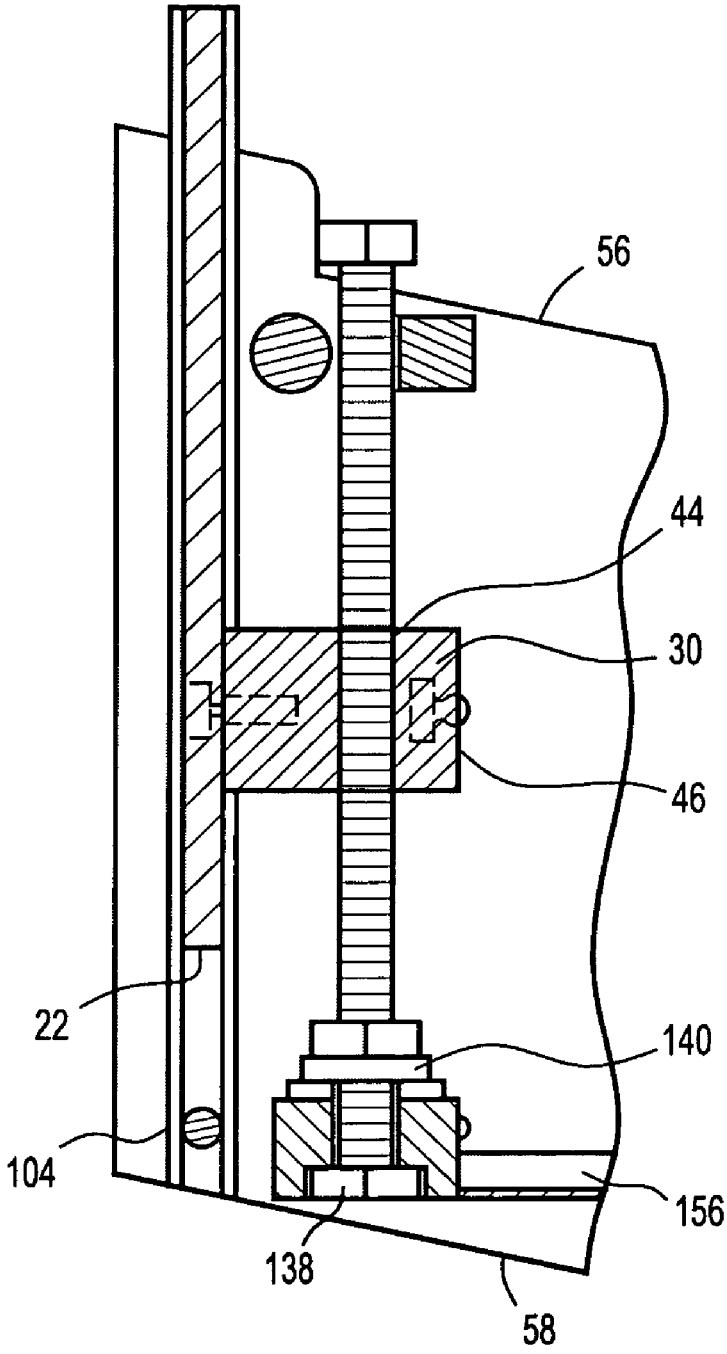
FIG. 4 is a side cross sectional view of the travel stop block taken along line 4-4 of FIG. 1.
Figure 5:
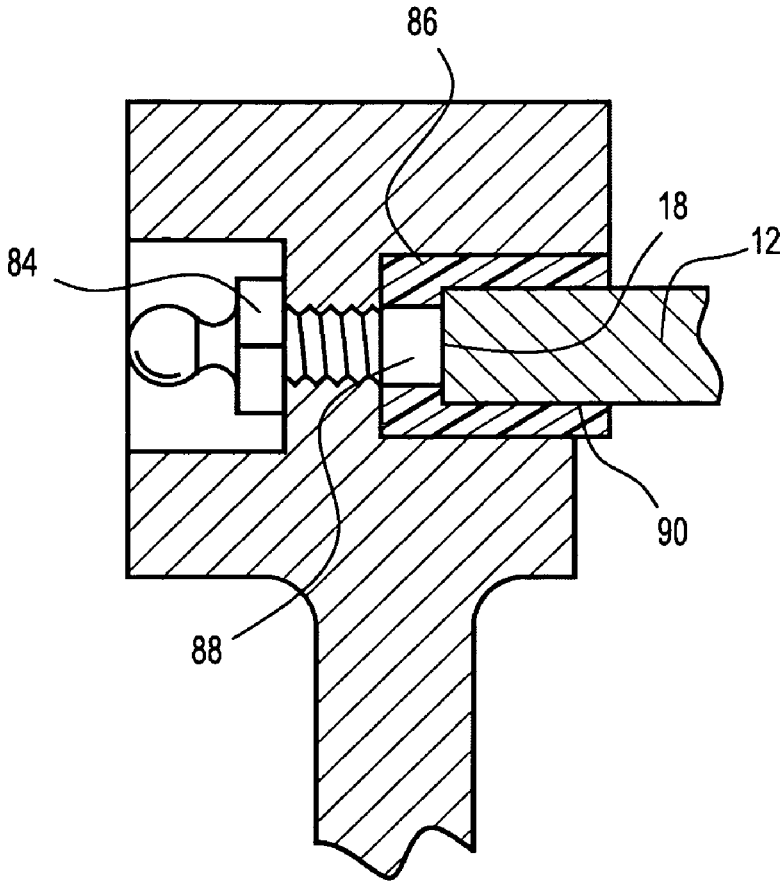
FIG. 5 is a cross sectional view taken along line 5-5 of FIG. 2.
Figure 6:
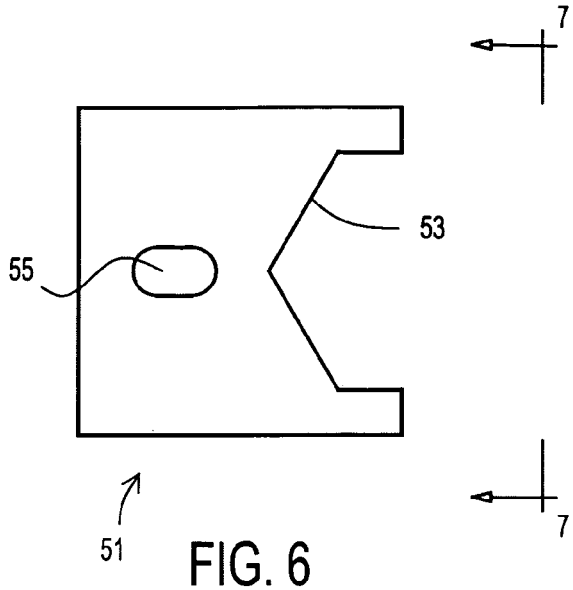
FIG. 6 is a top plan view of the hex head retainer. Note the slot.
Figure 7:
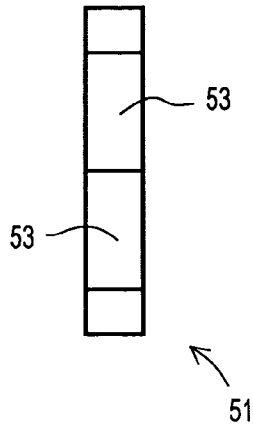
FIG. 7 is a view along line 7-7 of FIG. 6.
Figure 8:
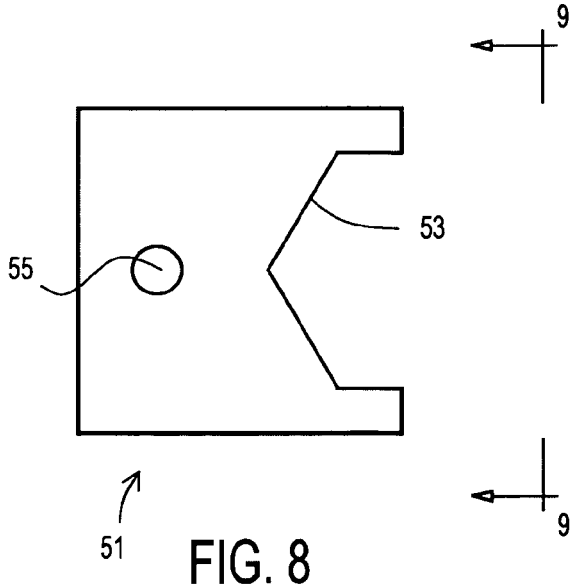
Figure 9:
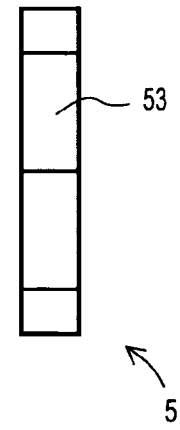
FIG. 9 is a view taken along line 9-9 of FIG. 8.

With reference now to the drawings, and in particular to FIG. 1 thereof, the preferred embodiment of the new and improved manually operated jack plate/travel stop system embodying the principles and concepts of the present invention and generally designated by the reference numeral 10 will be described.

To attain this, the present invention essentially comprises a manual operated jack plate/travel stop system.

First provided is a generally rectilinear transom plate 12. In the preferred embodiment, the transom plate is made of aluminum, though in other embodiments, other rigid materials could be used. The transom plate has a forward surface 14 and a rearward surface 16. The forward surface is placed in contact with the boat transom (not shown). The transom plate has a first thickness, or first external dimension, referred to as the edge.

The transom plate has two side edges 18, a top edge 20, and a bottom edge 22. The transom plate is position-able on the transom of a boat (not shown). The transom plate has a plurality of mounting bolt holes 24 there through. The associated transom bolts (not shown, but known in the art) pass through the transom plate from front to rear, and through the transom of a boat. The transom plate has a plurality of thread block holes 26 there through.

The transom plate has an associated thread block 30. The thread block has a top 32, a bottom 34, and four sides 36, including a front side 38 and a rear side 40. The thread block has a general rectilinear shape. The thread block as a plurality of threaded mounting block holes 42 that are mated with the thread block holes in the transom plate. The thread block mounting holes are located on the front side of the thread block, in the direction of the transom plate. The thread block is bolted to the transom plate. In other embodiments, the thread block may be welded to the transom plate, or may be continuous with, the transom plate.

The thread block has a threaded shaft hole 44 there through. The threaded shaft hole runs from the top of the thread block to the bottom of the thread block. The thread block shaft hole has an associated grease fitting 46 for allowing grease to be pumped into the thread block shaft hole. The thread block has a threaded stud hole (not shown). There is an associated stud 49 coupled into the stud hole, and an associated hex head lock 51 coupled there to. The hex head lock has a plurality of hex head engaging surfaces 53 and the hex lock has a stud hole 55 there through. The stud hole may be a round hole, or a slot. The round hole allows the user to lift the hex head lock off of the block, and the slot allows the user to slide the hex head lock away from the hex head, so as to turn the hex head.

Next provided is a pair of similarly configured vertically disposed side rails 50. The side rails are mirror images of each other, each side rail having a front 52, a rear 54, a top 56, a bottom 58, an inner surface 60, and an outer surface 62. Each of the side rails has a forward edge 64 and a rearward edge 66.

The side rails are in a generally trapezoidal configuration when viewed from the side 70, and an L-shaped configuration 72 when viewed from above, or from top down. Each of the side rails has a short leg portion 74 and a long leg portion 76. The short leg portion runs from the rear edge of the side rail, inwardly. The long leg portion runs from the rear edge, forward. The forward end of the side rail has a generally rectangular enlargement 80 running the length of the forward edge, from top to bottom.

The rectangular enlargement has a groove 82 running from top to bottom. The rectangular enlargement has a grease fitting 84 communicating with the surface of the groove. The groove has a second internal width, or dimension. The groove has an associated groove insert 86. The groove insert has a grease hole 88 there through. The groove insert grease hole aligns with the grease fitting of the rectangular enlargement of the side rails.

The groove insert has a generally C-shaped configuration having an internal width, or dimension, and an external width, or dimension, and a depth. This configuration forms a recess 90. The internal width has a third dimension. The third dimension is larger than the first dimension of the transom side edge. This allows the transom side edge to be nested within the recess of the groove insert. The groove insert also has a fourth external dimension. The fourth external dimension is smaller than the second internal dimension of the side rail groove. This allows the insert to be nested within the side rail enlargement groove located in the forward end of the long leg portions of the side rail. This sizing allows the insert to be nested within the rectangular enlargement, and allows the side rail to slide up and down the length of the insert.

The insert is fabricated of a synthetic material, such as nylon or other plastic. This combination of plastic and metal provides for a smooth, lubricious interface between the transom plate and the side rails.

Each of the long leg portions of each of the side rails has a plurality of cross strut holes 92 there through.

Each of the side rails has a rearwardly located short leg. The short leg of the side rail runs inwardly from each of the side rails, and forms a surface for receiving an outboard motor mount (not shown). Each of the short legs of the side rails has a forward surface 94 and a rearward surface 96 and a thickness there between. Each of the short legs of the side rails has a plurality of motor mount bolt holes 98 there through.

Each of the side rails has a plurality of splash plate 100 mounting apertures there through.

Next provided are a plurality of cross struts. The cross struts have a generally solid cylindrical, rectangular configuration (cylindrical being defined as continuous and of a single shape, not confined to being round). Two of the cross struts, an upper cross strut and a lower cross strut are rectangular shaped cylinders 102, and two of the cross struts are round cylinders 104. The rectangular configured struts each have two ends with a threaded bolt 106 hole on each of the two ends. The round shaped struts each have two ends with each side having a protruding thread 108. The thread is smaller in external diameter than the cross strut, forming a shoulder at the inward end of the thread. The shoulder allows the round cross strut to function as a spacer, keeping the side rails apart, while having an associated thread nut 112 coupled thereto so as to hold the side rails together, effectively fixing the side rails in place. The protruding thread of the round cross strut is sized to fit into the apertures located in the side rails. The upper cross strut has a hole therein to receive an bolt or a stud, for coupling a hex head lock thereto.

The cross struts couple the two side rails to from a rigid structure. There is a pair of upper cross struts, one round and one rectangular, and a pair of lower cross struts, one round and one rectangular. The lower rectangular cross strut has a generally rectangular configuration with a top surface, a bottom surface, and a pair of parallel side surfaces. The rectangular lower cross strut has a rod aperture 122 running from top to bottom at the approximate center of the cross strut, at a point approximately equidistant from the ends of the cross strut. The rod aperture has a stepped configuration having a smaller diameter aperture 126 and a larger diameter recess 128 associated there with. The larger diameter aperture being lowermost on the lower surface of the lower cross strut. The rod aperture has a grease fitting 130 associated there with.

The round lower cross strut is positioned in the side rail groove so as to act as a stop, to keep the insert from migrating downward, and out of the groove in the rectangular enlargement of the side rail.

Next provided is a threaded rod 132. The threaded rod has a top end 134 and a bottom end 136 with a length there between. The threaded rod has a hexagonally configured head, like the head of a bolt. This allows the placement and turning of the threaded rod by a wrench or socket.

The hex head of the threaded rod has, as described above, an associated hex head lock. The hex head lock has a mounting portion having a hole and a gripping portion having surfaces that are configured to contact and hold the hex head of the threaded rod. The mounting portion is configured to be fixedly attached to the jack plate adjacent the hex head, on the upper strut. The gripping portion is configured to grip the hex head and hold the hex head fast, preventing any movement or rotation. The hex head lock is mounted cross strut.

In another embodiment, the hex head may be mounted so as to be able to contact the hex head from above the hex head. In this configuration the hex head lock engages the upper surface of the hex head and the side surfaces of the hex head with a plurality of prongs or fingers, so as to prevent rotation of the hex head, thereby preventing any hex head movement, and hence turning of the threaded rod, or the lock may be pivoted causing the gripping portion to be disengaged from the hex head, allowing a user to turn the hex head with a wrench, or any other turning means, thereby adjusting the height of the motor in relation to the stern of the boat.

The threaded rod has a pair of locking nuts located at the lower end. The first locking nut 138 has a hexagonal configuration and is nested within the recess of the lower cross strut rod aperture. The second locking nut has a flange or washer 140 and is located on the threaded rod above the lower cross strut, and contacting the lower cross strut. The locking nuts provide the connection between the threaded rod and the lower cross strut. The threaded rod is threaded into and through the threaded block, with the threads of the block and the rod being mated. The threaded rod then passes through the lower strut, and is coupled to the lower strut as described above. This configuration allows the turning of the threaded rod by turning of the hex head. The turning of the threaded rod then pulls up on the lower strut, lifting the side rails relative to the transom plate.

In another embodiment the threaded rod may be fixedly coupled to the lower cross strut by a fixing means, such as a pin, a clip, a snap ring, a snap, a wire, and a clamp. The fixing means may pass through the rod or may be coupled about its periphery.

In another embodiment the rod may have a hole there through at the lowermost end, through which a castleated nut (not shown) may be there fixed.

Provided next is a splash plate 150. The splash plate has a generally rectangular configuration. The splash plate has an upper surface 152, a lower surface 154, and a side edge 156 with a thickness, there between. The splash guard plate has a lip 158, or flange, for mounting the splash plate to the side rails. The flange has a plurality of attachment holes 160 that match with the splash plate mounting apertures in the side rail. The splash plate holes have associated bolts 162. The splash plate is oriented between the side plates, being within the perimeter formed by the side plates and the transom plate. The splash plate is oriented to be generally parallel with the surface of the water so as to prevent upward splashing of water during boat operation.

In another embodiment a travel stop block 170 is provided. The travel stop block is not used in a manually operated system, but is a conversion piece if the manually operated system was to be converted to a hydraulically operated system. While a travel stop block is not necessary in the manually operated system, it may be used without adverse affects. The travel stop block has a rectangular configuration. The travel stop block has parallel front 172 and rear faces 174. The travel stop block has parallel top and bottom faces. The travel stop block also has parallel side faces. The parallel side faces are provided between the forward and rear and top and bottom faces. The travel stop block has a pair of vertically aligned apertures (not shown) in the forward face. The apertures are aligned with the apertures of the transom plate and with associated bolts extending through the apertures of the transom plate and the travel stop block. In this manner the travel stop block is secured to the transom plate. A warning sticker 178 is provided on the rearward face of the travel stop block. The height of the travel stop block between the upper and lower faces is between about 30 and 70 percent of the distance between the upper and lower cross struts. The travel stop block is located between the upper and lower struts. When the motor is coupled to the side rails, and is in a lower most orientation, the travel stop block will be in contact with the lower cross strut. In this manner further downward movement is precluded. When the motor is in an upper most orientation, the travel stop block will be in contact with the upper cross strut. In this manner further upward movement is precluded during operation and use.

The drawings show the travel stop block which is a conversion option when converting the manually operated system to a hydraulically operated one. The location of the travel stop block shows where the holes through the plate are located.

In operation, the upper hex head of the threaded rod is turned with wrench, or some other tool. The turning of the rod moves the lower cross strut upward or downward, thereby moving the motor mount upward or downward.

It is anticipated that the configuration as described above may also be used with the replacement of the manually turned threaded rod with a hydraulic cylinder ram. This would allow for the efficient conversion of the system as described, from a manually operated system to a hydraulically operated system. The hydraulic cylinder would have either a motor driven pump, or a manually driven pump. In either hydraulic operation, the motivating force would be applied remote from the jack plate itself.

To carry out the replacement, or upgrade, that is, to convert the manually operated jack plate to a hydraulically operated power jackplate, the following steps are taken. First the engine is removed from the jackplate. The jackplate is then removed from the boat's transom. The jackplate is completely disassembled. The parts that are common to the manual and power jack plate are the side rails, splash pan, tensioning rods and slide plate. The bolt holes in the manual and powered jack plates will be located and sized the same. As a form of quality control, an identifying serial number will be engraved upon a specific location of one of the parts, prior to re-assembly. This enables the maintenance records to accurately track and identify the upgraded jack plates.

The conversion from manual to hydraulic requires a revised bottom cross member, a hydraulic cylinder, pumps and associated controls, a clevis bracket, travel stop block, and mounting bolts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A manually operated jack plate/travel stop system comprising:

a transom plate having a forward surface and a rearward surface with a first thickness, the transom plate having two side edges and a top edge and a bottom edge, the transom plate having a plurality of mounting bolt holes there through with associated transom bolts passing through the transom plate and through the transom of a boat, the transom plate having a plurality of thread block holes there through;

a thread block having a to and a bottom and four sides including a front side and a rear side, the thread block having a general rectilinear shape with a plurality of threaded mounting block holes there in, the threaded mounting holes being sized to be mated with the thread block holes in the transom plate, with the thread block having a threaded shaft hole there through;

a pair of similarly configured side rails being mirror images of each other with each of the side rail having a front and a rear and a top and a bottom and an inner surface and an outer surface, each of the side rails having a forward edge and a rearward edge, each of the side rails having a rectangular enlargement with the rectangular enlargement having a groove running from top to bottom;

the groove having an associated groove insert, the groove insert having a grease hole there through;

a plurality of cross struts with each strut having a generally solid cylindrical configuration and having two ends with a length there between;

the threaded rod having a first locking nut and a second locking nut, the locking nuts located at the lower end of the threaded rod;

a travel stop block having a rectangular configuration and parallel front and rear faces, the travel stop block having parallel top and bottom faces with parallel side faces, the parallel side faces being located between the forward face and rear face and top face and bottom face;

a splash plate; and a threaded rod having a top end and a bottom end with a length there between.

2. The manually operated jack plate/travel stop system as described in claim 1 with the system further comprising:

the threaded block mounting holes being located on the front side of the thread block, the threaded shaft hole running from the top of the thread block to the bottom of the thread block, the thread block shaft hole having an associated grease fitting therein;

the side rails having a generally trapezoidal configuration when viewed from the side, and an L-shaped configuration when viewed from above from top down, each of the side rails having a short leg portion and a long leg portion with the short leg portion running from the side rail, inwardly, the long leg portion running from the rear to the front;

the groove insert having a grease hole aligning with the grease fitting of the rectangular enlargement of the side rail, the groove insert having a generally C-shaped configuration with an internal width and an external width and a depth, forming a recess therein;

the struts comprising two rectangular shaped struts having threaded bolt holes on each of the two ends and two round shaped struts with each round strut having two ends with each side having a protruding thread, the protruding thread being sized to fit into the apertures located in the side rails, the cross struts comprising an upper strut and a lower strut, the struts coupling the two side rails to form a rigid structure, the lower rectangular cross strut having a rod aperture running from top to bottom at the approximate center of the cross strut, at a point approximately equidistant from the ends of the cross strut, the rod aperture having a stepped configuration having a smaller diameter aperture and a larger diameter recess associated there with, the larger diameter aperture being lowermost on the lower surface of the lower cross strut;

the threaded rod first locking nut having a hexagonal configuration and being nested within the recess of the lower cross strut rod aperture, the second locking nut having a flange and being located on the threaded rod above the lower cross strut and contacting the lower cross strut, with the thread rod having a hex head lock associated with the hex head of the threaded rod, the hex head lock having a hole there through for coupling the hex head lock to the upper cross strut hole;

the travel stop block having a pair of vertically aligned apertures in the forward face, the apertures being aligned with the apertures of the transom plate, with associated bolts extending through the apertures of the transom plate and the travel stop block; and the splash plate having a generally rectilinear configuration with a pair of turned edges.

3. The manually operated jack plate/travel stop system as described in claim 2 with the system further comprising:

the rectangular enlargement of each of the side rails being located at the front of each of the side rails, the rectangular enlargement running the length of the forward edge, from top to bottom, the enlargement having an associated grease fitting communicating with the surface of the groove, with the groove having a second internal width;

the internal width of the groove insert having a third dimension, the third dimension being larger than the first dimension of the transom side edge, the transom edge being nested within the recess of the groove insert, the groove insert having a fourth external dimension, the fourth external dimension being smaller than the second internal dimension of the side rail groove, the insert being nested within the side rail enlargement groove located in the forward end of the long leg portions of the side rail and allows the side rail to slide up and down the length of the insert, with each of the long leg portions of each of the side rails having a plurality of cross strut holes there through, with each of the side rails having a rearwardly located short leg inwardly from each of the side rails, the short leg forming a surface for receiving an outboard motor mount, each of the short legs of the side rails having a forward surface and a rearward surface and a thickness there between, each of the short legs of the side rails having a plurality of motor mount bolt holes there through;

the rod aperture having a grease fitting associated there with;

the locking nuts providing connection between the threaded rod and the lower cross strut, the threaded rod being threaded into and through the threaded block, with the threads of the block and the rod being mated, the threaded rod then passing through the lower strut and coupling to the lower strut;

the travel block having a warning sticker provided on the rearward face thereof, the height of the travel stop block between the upper and lower faces being between about 30 and 70 percent of the distance between the upper and lower cross struts, the travel stop block being located between the upper and lower struts; and, the splash plate having a plurality of bolt holes located in the turned edges, for coupling the splash plate to the lower edge of the side rails.

4. A manually operated jack plate/travel stop system as described in claim 1 with the travel stop block being located between an upper and lower cross struts whereby when the side rails and motor are in a lower most orientation, the travel stop block will be in contact with a lower cross strut and whereby when the side rails and motor are in an upper most orientation, the travel stop block will be in contact with an upper cross strut.

5. A manually operated jack plate/travel stop system comprising:

a generally rectilinear transom plate having a forward surface and a rearward surface with a first thickness, the transom plate having two side edges and a top edge and a bottom edge, the transom plate having a plurality of mounting bolt holes there through with associated transom bolts passing through the transom plate and through the transom of a boat, the transom plate having a plurality of thread block holes there through;

a thread block having a top and a bottom and four sides including a front side and a rear side, the thread block having a general rectilinear shape with a plurality of threaded mounting block holes there in, the threaded mounting holes being sized to be mated with the thread block holes in the transom plate, with the thread block mounting holes being located on the front side of the thread block, with the thread block having a threaded shaft hole there through, the threaded shaft hole running from the top of the thread block to the bottom of the thread block, the thread block shaft hole having an associated grease fitting therein;

a pair of similarly configured vertically disposed side rails being mirror images of each other, with each side rail having a front and a rear and a top and a bottom and an inner surface and an outer surface, each of the side rails having a forward edge and a rearward edge, the side rails having a generally trapezoidal configuration when viewed from the side, and an L-shaped, configuration when viewed from above from top down, each of the side rails having a short leg portion and a long leg portion with the short leg portion running from the side rail, inwardly, the long leg portion running from the rear to the front, with the front of each of the side rails having a generally rectangular enlargement running the length of the forward edge, from top to bottom, the rectangular enlargement having a groove running from top to bottom, the enlargement having an associated grease fitting communicating with the surface of the groove, with the groove having a second internal width;

a groove insert having a grease hole there through, the groove insert grease hole aligning with the grease fitting of the rectangular enlargement of the side rail, the groove insert having a generally C-shaped configuration with an internal width and an external width and a depth, forming a recess therein, the internal width having a third dimension, the third dimension being larger than the first dimension of the transom side edge, the transom edge being nested within the recess of the groove insert, the groove insert having a fourth external dimension, the fourth external dimension being smaller than the second internal dimension of the side rail groove, the insert being nested within the side rail enlargement groove located in the forward end of the long leg portions of the side rail and allows the side rail to slide up and down the length of the insert, with each of the long leg portions of each of the side rails having a plurality of cross strut holes there through, with each of the side rails having a rearwardly located short leg inwardly from each of the side rails, the short leg forming a surface for receiving an outboard motor mount, each of the short legs of the side rails having a forward surface and a rearward surface and a thickness there between, each of the short legs of the side rails having a plurality of motor mount bolt holes there through;

four cross struts with each strut having a generally solid cylindrical configuration and having two ends with a length there between with two rectangular shaped struts having threaded bolt holes on each of the two ends and two round shaped struts each have two ends with each side having a protruding thread, the protruding thread being sized to fit into the apertures located in the side rails, the cross struts coupling the two side rails to from a rigid structure the lower rectangular cross strut having a rod aperture running from top to bottom at the approximate center of the cross strut, at a point approximately equidistant from the ends of the cross strut, the rod aperture having a stepped configuration having a smaller diameter aperture and a larger diameter recess associated there with, the larger diameter aperture being lowermost on the lower surface of the lower cross strut, the rod aperture having a grease fitting associated there with;

a threaded rod having a top end and a bottom end with a length there between, the threaded rod having a pair of locking nuts located at the lower end, the first locking nut having a hexagonal configuration and being nested within the recess of the lower cross strut rod aperture, the second locking nut having a flange and being located on the threaded rod above the lower cross strut and contacting the lower cross strut, the locking nuts providing connection between the threaded rod and the lower cross strut, the threaded rod being threaded into and through the threaded block, with the threads of the block and the rod being mated, the threaded rod then passing through the lower strut and coupling to the lower strut;

a travel stop block having a rectangular configuration and parallel front and rear faces, the travel stop block having parallel top and bottom faces with parallel side faces, the parallel side faces being located between the forward face and rear face and top face and bottom face, the travel stop block having a pair of vertically aligned apertures in the forward face, the apertures being aligned with the apertures of the transom plate, with associated bolts extending through the apertures of the transom plate and the travel stop block, the travel block having a warning sticker provided on the rearward face thereof, the height of the travel stop block between the upper and lower faces being between about 30 and 70 percent of the distance between the upper and lower cross struts, the travel stop block being located between the upper and lower struts.

* * * * *